US005115973A

United States Patent [19]

Fuller et al.

[11] Patent Number: 5,115,973

[45] Date of Patent: May 26, 1992

[54] WATER DISPLAYS

[75] Inventors: Mark W. Fuller, Studio City; Alan S. Robinson, El Monte, both of Calif.

[73] Assignee: Wet Design, Universal City, Calif.

[21] Appl. No.: 732,135

[22] Filed: Aug. 19, 1991

Related U.S. Application Data

[62] Division of Ser. No. 555,311, Jul. 20, 1990, Pat. No. 5,078,320, which is a division of Ser. No. 160,720, Feb. 26, 1988, Pat. No. 4,955,540.

[51] Int. Cl.[5] ..... F21P 7/00

[52] U.S. Cl. ..... 239/20; 362/96

[58] Field of Search ..... 239/18-20; 362/96, 101; 40/406, 407

[56] References Cited

U.S. PATENT DOCUMENTS

| | | | |
|---|---|---|---|
| 3,907,204 | 9/1975 | Pryzstawik | 239/19 |
| 4,002,293 | 1/1977 | Simmons | 239/17 |
| 4,749,126 | 6/1988 | Kessener et al. | 239/18 |
| 4,901,922 | 2/1990 | Kessener et al. | 239/18 |
| 4,936,506 | 6/1990 | Ryan | 239/18 |

FOREIGN PATENT DOCUMENTS

| | | | |
|---|---|---|---|
| 2562637 | 10/1985 | France | 239/18 |

*Primary Examiner*—Andres Kashnikow
*Assistant Examiner*—Lesley D. Morris
*Attorney, Agent, or Firm*—Blakely, Sokoloff, Taylor & Zafman

[57] ABSTRACT

Water displays utilizing laminar flow streams to create dynamic arch-like displays are disclosed. The laminar flow nozzle is mounted on an assembly for changing the angle and repositioning the laminar flow nozzle so that the laminar flow stream appears to eminate from a fixed location at different angles, which allows varying the characteristics of the display in a dynamic manner. Simultaneous control of the nozzle position and angle with control of the pressure of water supplied thereto allows the stream to be varied to create a dynamic display with the stream returning to a sink region at a fixed position independent of the height of the water stream. Illuminating the laminar flow stream internally causes the same to glow like a fluorescent tube with the color being supplied thereto, changeable as desired. Intersecting laminar flow streams provide interesting water formations, with the intersections of two streams of different colors causing still a third color at the flared region of the intersection. Features of the invention are useable independently, all in the same apparatus, or in various combinations as desired.

2 Claims, 6 Drawing Sheets

Fig. 7
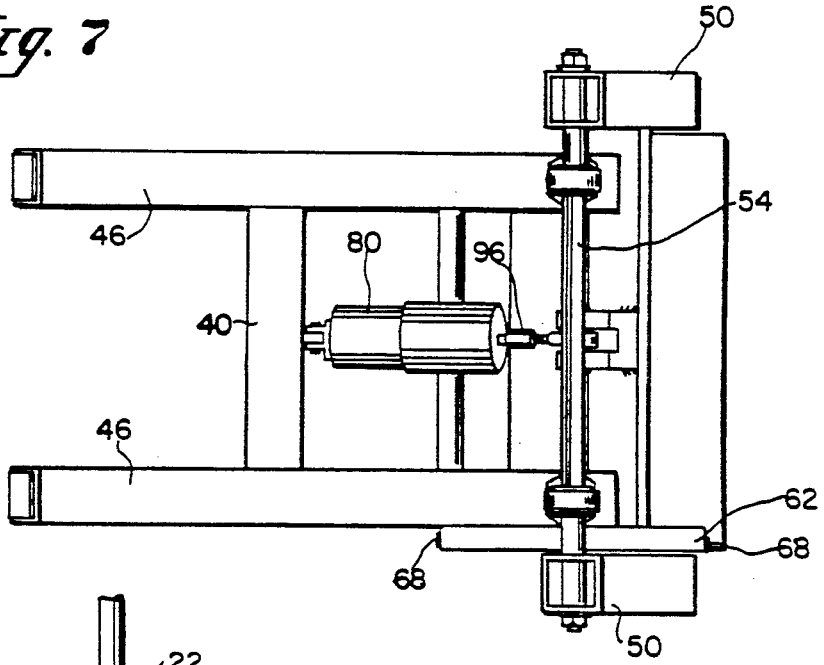
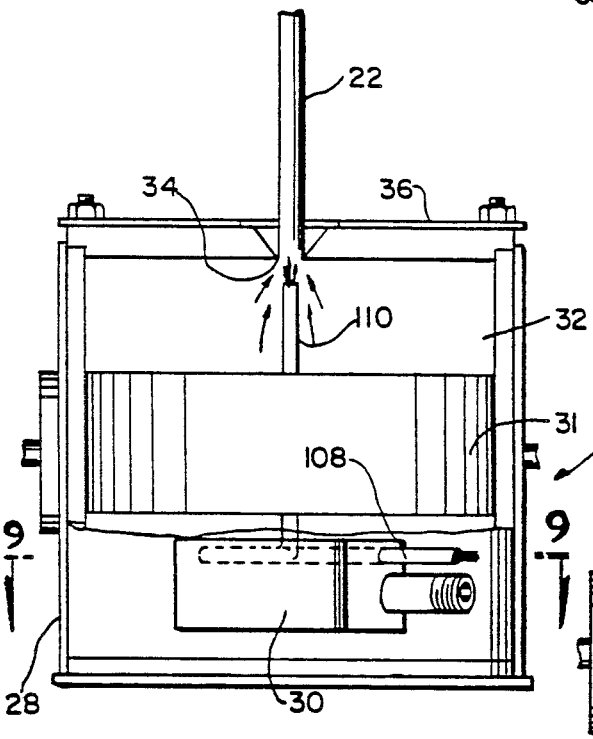
Fig. 8
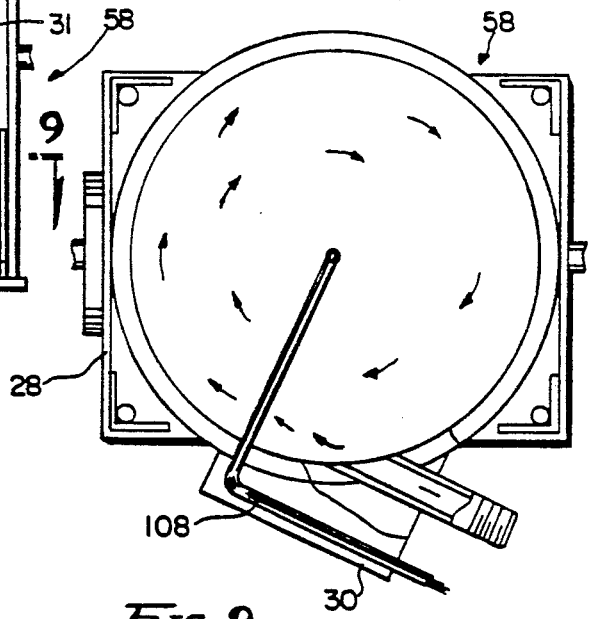
Fig. 9

WATER DISPLAYS

This is a divisional of application Ser. No. 555,311, filed Jul. 20, 1990, now U.S. Pat. No. 5,078,320, which is a divisional application of application Ser. No. 160,720 filed Feb. 26, 1988, now U.S. Pat. No. 4,955,540.

BACKGROUND OF THE INVENTION

1. Field of the Invention

The present invention relates to the field of water displays.

2. Prior Art

In EPCOT Center, in Disney World in Florida, laminar flow nozzles have been used to provide a water display known as the Leapfrog fountain. That water display is characterized by a plurality of laminar flow nozzles spaced unequal distances apart to traverse an area. At each position, a laminar flow nozzle directs a laminar flow stream toward an adjacent laminar nozzle position. Adjacent each laminar flow nozzle position is also a sink region designed so that the splash resulting from a laminar flow stream entering the sink region will be minimized and the water recovered for continuous use. Each nozzle therefore is capable of directing a laminar flow stream in an arch from the respective nozzle to the sink region of an adjacent nozzle utilizing an arch of fixed height and span. Two laminar flow nozzles are located at each nozzle position so that the laminar flow streams may be directed in either direction around the pattern as desired. By control of the streams, the Leapfrog displays may create a sea serpent like appearance, in effect appearing as if a single stream of a fixed length eminates from the ground, loops through the ground at other points and ultimately disappears into the ground.

By the proper coordination of the laminar flow streams, such fountains may be given a form of personality all their own, being a source of amusement to children and adults alike. This was developed by the inventors of this patent for disney. As a result, the assignee of the present invention has installed this general type of fountain at various locations throughout the world under licensee agreement with Disney. The purpose of the present invention is to extend the use of laminar flow nozzles through still new and different water displays to provide further unusual effects commanding attention in both daytime and evening environments.

BRIEF SUMMARY OF THE INVENTION

Water displays utilizing laminar flow streams to create dynamic arch-like displays are disclosed. The laminar flow nozzle is mounted on an assembly for changing the angle and repositioning the laminar flow nozzle so that the laminar flow stream appears to eminate from a fixed location at different angles, which allows varying the characteristics of the display in a dynamic manner. Simultaneous control of the nozzle position and angle with control of the pressure of water supplied thereto allows the stream to be varied to create a dynamic display with the stream returning to a sink region at a fixed position independent of the height of the water stream. Illuminating the laminar flow stream internally causes the same to glow like a neon tube with the color being supplied thereto, changeable as desired. Intersecting laminar flow streams provide interesting water formations, with the intersection of two streams of different colors causing still a third color at the flared region of the intersection. Features of the invention are useable independently, all in the same apparatus, or in various combinations as desired.

BRIEF DESCRIPTION OF THE DRAWINGS

FIG. 7 is a partial cross section taken along line 7—7 of FIG. 6.

FIG. 8 is a partial cross section of a typical laminar flow nozzle.

FIG. 9 is a cross section of the laminar flow nozzle taken along lines 9—9 of FIG. 3.

DETAILED DESCRIPTION OF THE INVENTION

Figure 1:
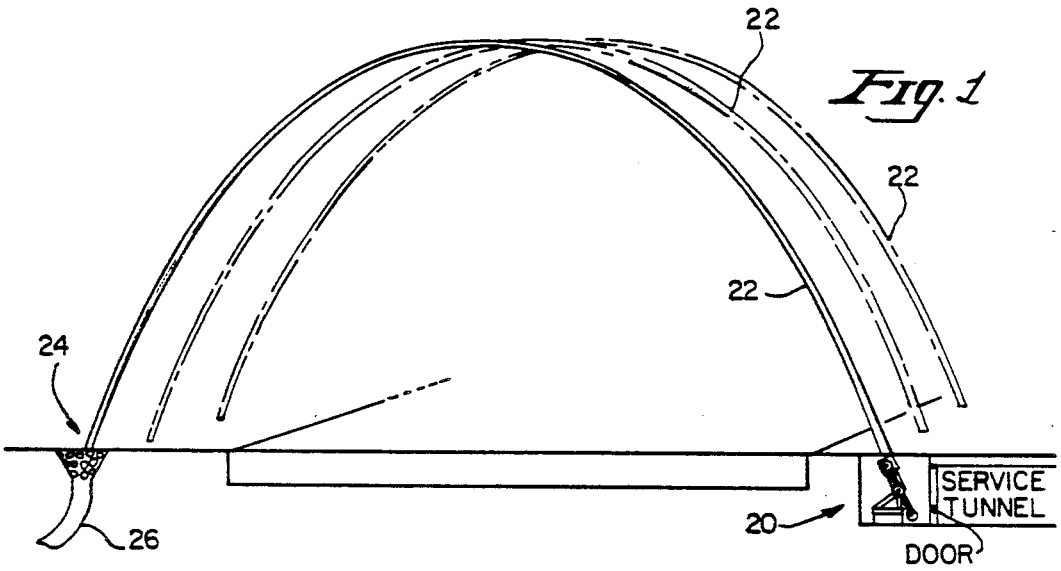
FIG. 1 is an illustration of one form of water display in accordance with the present invention.
Figure 2:
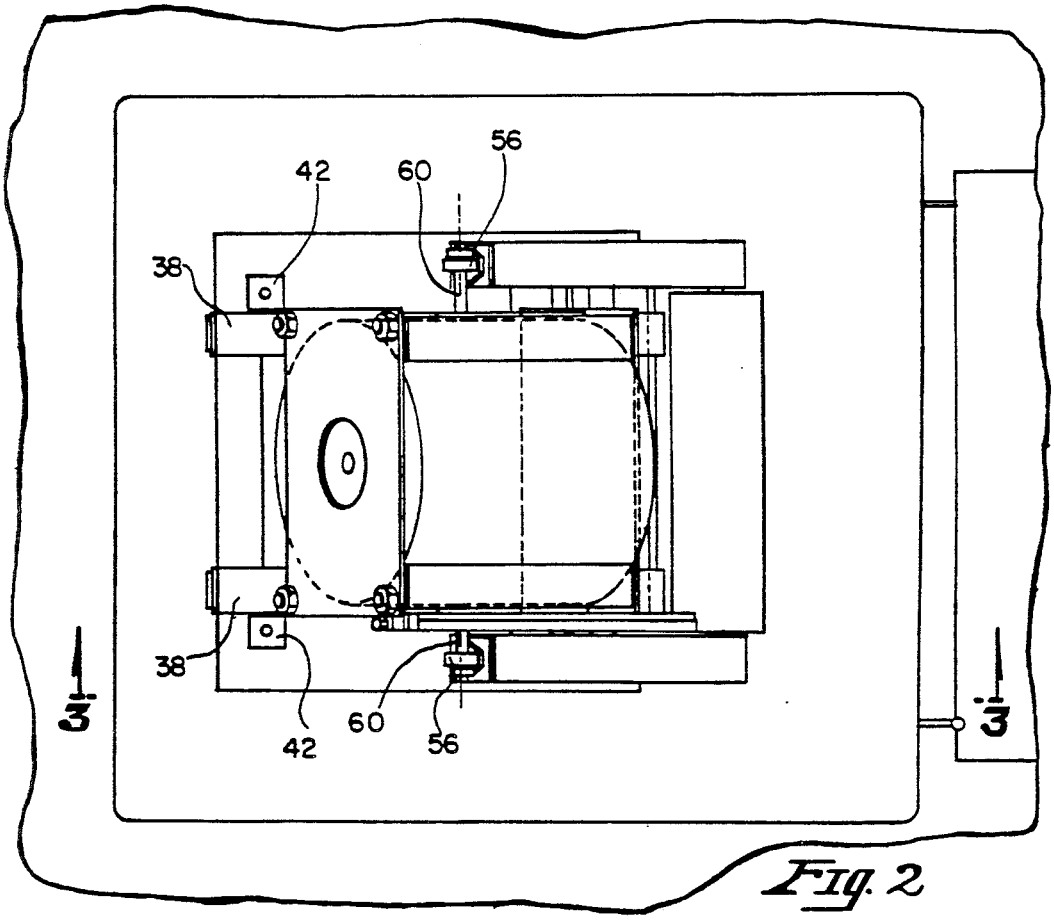
FIG. 2 is a top view of the laminar flow nozzle and supporting apparatus in accordance with the preferred embodiment of the present invention.
Figure 3:
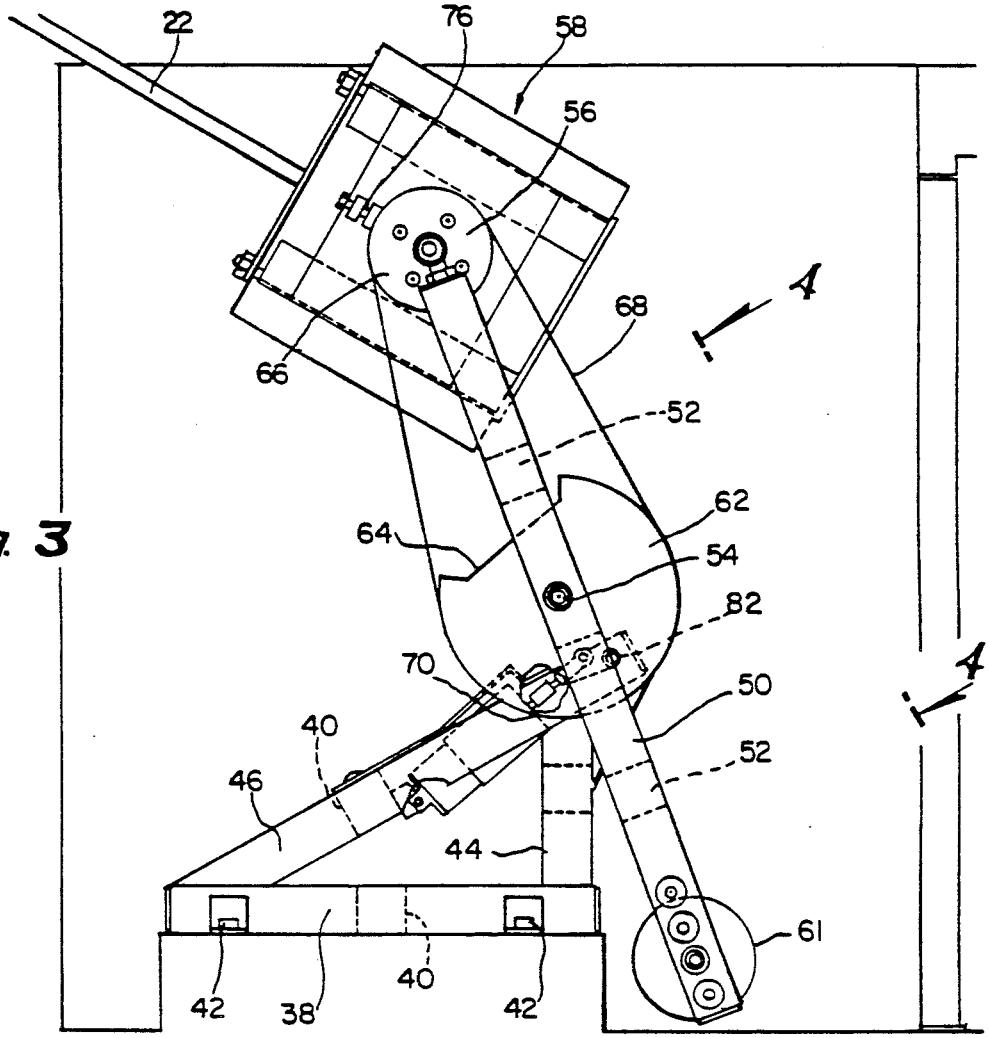
FIG. 3 is a view taken along line 3—3 of FIG. 2.
Figure 4:
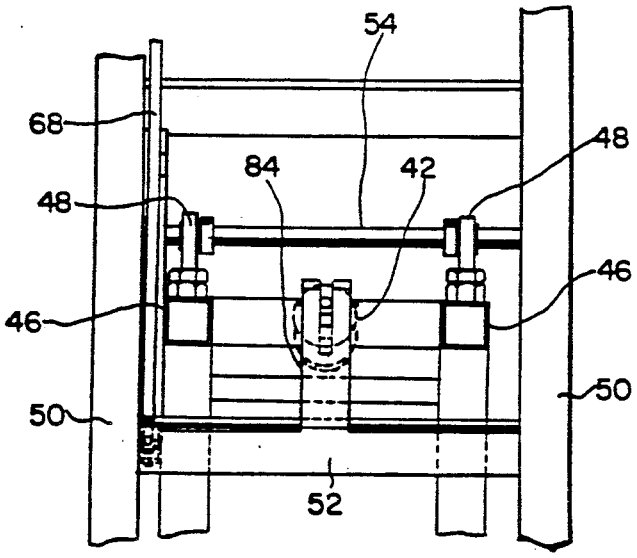
FIG. 4 is a view taken along line 4—4 of FIG. 3.
Figure 5:
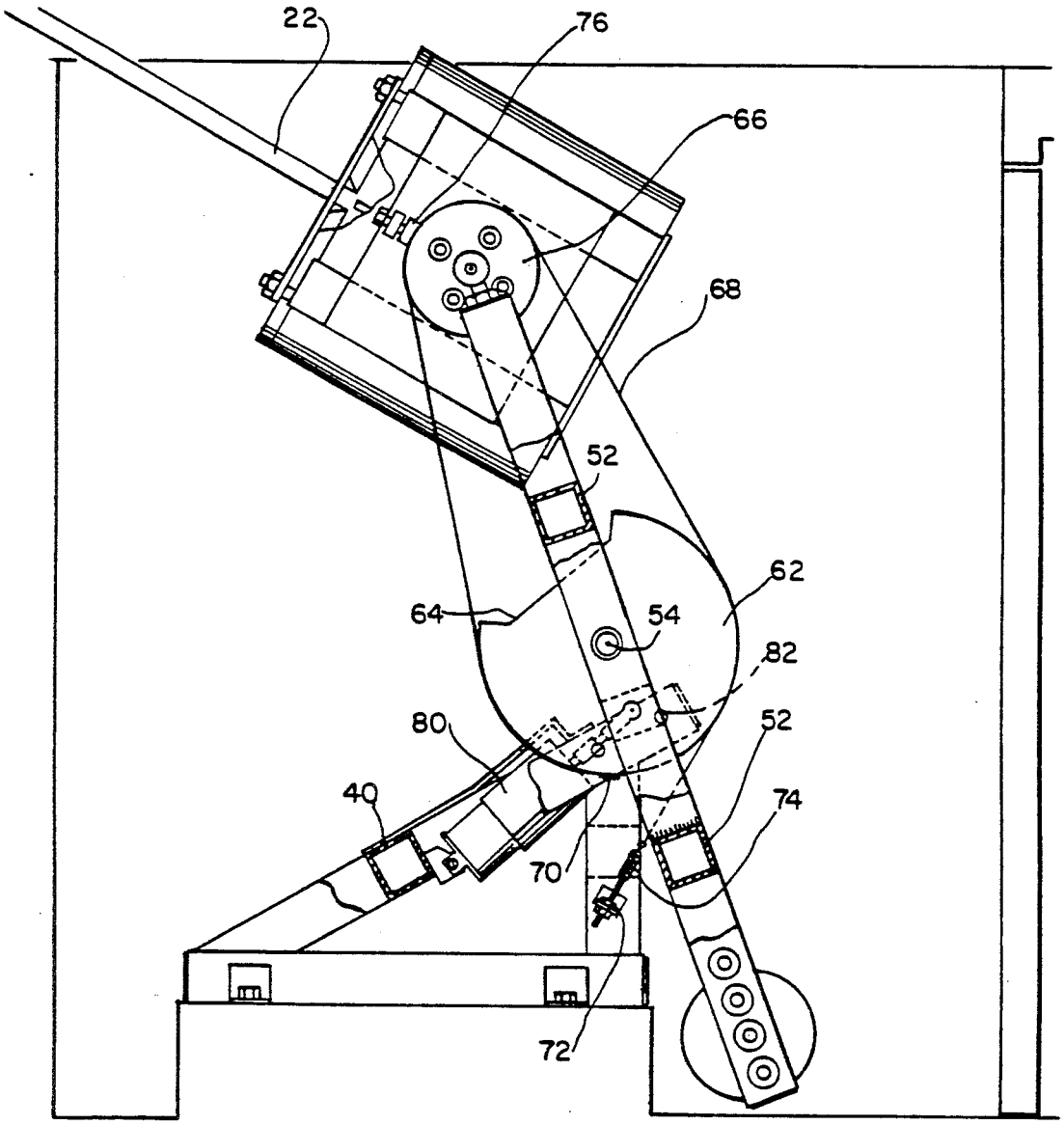
FIG. 5 is a side view similar to FIG. 3 though taken on a partial cross section.

First referring to FIG. 1, an illustration of one embodiment of the present invention may be seen. In this embodiment a laminar flow nozzle, generally indicated by the numeral 20, is located below ground level and directed to project a laminar flow stream 22 upward in an arch, curving to a "sink" area, generally indicated by the numeral 24, which receives the laminar flow stream with minimal splash and recovers the water therefrom through a drain 26 for filtering and reuse in the system. The sink area 24 may take various forms, though frequently small rocks supported on an appropriate screen are used to provide a natural looking setting, yet one that will receive the stream in the desired manner. As may be seen in FIG. 1, in this embodiment a plurality of archlike streams 22 are provided to create a canopy like affect useable for entrances to shopping centers and the like.

Details of the laminar flow nozzles used with the present invention may be seen in FIGS. 8 and 9. The nozzles are characterized by a cylindrical enclosure 28 having a water inlet 30 adjacent the bottom thereof for providing water under pressure to the enclosure. Above the water inlet is a flow straightening and turbulence reducing means 30 for providing a plurality of relatively small flow passages therethrough, such as by way of example a rigid, open celled foam or the like. Thereabove is a plenum 32 below an exit orifice 34 in the top of cover 36 of the enclosure. The exit orifice is a sharp orifice so as to provide negligible viscous drag on the laminar flow stream 22 eminating therefrom. Accordingly the flow in the stream 22 is not only laminar flow, but is also slug flow, highly desireable for the present invention. In that regard, laminar flow is flow wherein local streamlines are parallel. This is to be compared with turbulent flow, wherein streamlines cross each other, indicating a mixing of the fluid in the flow. In the case of a fully developed laminar flow within a tube, the flow profile is essentially parabolic, having a maximum velocity at the center of the tube, which velocity decreases with radius due to viscous drag to a zero velocity at the wall of the tube. Slug flow, on the other hand, is flow which is not only laminar and therefore has local streamlines which are parallel to each other, but further which has the same velocity for all streamlines across a cross section of the flow area. The slug flow is generated by the laminar flow nozzle of FIGS. 8 and 9 as a result of the sharp edged orifice 34 which does not have any meaningful area contacting the high velocity stream 22. Obviously perfect laminar flow and perfect slug flow cannot be achieved, but can only be approached, though slug flow is preferred in the present invention because of the better laminar flow that normally results, and further because the dynamic results in many embodiments of the present invention are enhanced as a result of a slug flow, as shall be more specifically commented on later.

Now referring to FIGS. 2 through 7, details of the suspension of the laminar flow nozzles of the present invention may be seen. A base comprising parallel base members 38 maintained in spaced apart relationship by transverse members 40 welded thereto (see FIG. 3) have flanges 42 thereon for fastening the assembly in position in the desired installation. Rigidly welded to this base is a pair of uprights 44 adjacent one end thereof, and a pair of inclined members 46 forming a triangular structure with the base as viewed from the side. Fastened to and adjacent the upper end of members 46 are rod end bearings 48, as may be seen in FIG. 4, a view taken along line 4—4 of FIG. 3 looking along the plane of members 46. These rod end bearings in turn support a shaft 54 extending therethrough supporting on the ends thereof a structure comprising parallel members 50 held in spaced apart relationship by welded cross members 52 (see FIGS. 3 and 5). Members 50 have fastened to the upper end thereof additional rod end bearings 56 supporting the laminar flow nozzle, generally indicated by the numeral 58, on shaft like protrusions 60 (see FIG. 2) coupled to the laminar flow nozzle. Preferably the laminar flow nozzle is supported approximately on its center of gravity so as to be freely rotatable on the rod end bearings 56 without substantial unbalance. At the opposite end of parallel members 50 is a counterweight 62, a solid metal weight, to counterbalance the weight of the laminar flow nozzle 58 about the axis defined by the shaft 54 and rod end bearings 48 (see FIG. 4).

Rigidly fastened to member 46 is a wheel-like member 62 (see particularly FIGS. 3, 5 and 6), the wheel-like member being relieved in region 64 for clearence with one of cross members 52. Also mounted in the same plane as wheel-like member 62 is a wheel 66 rigidly coupled to the nozzle 58 so that rotation of the wheel 66 will cause rotation of the laminar flow nozzle 58 therewith about the axis of the rod end bearings 56. The wheel-like member 62 and the wheel 66 are coupled by a stainless steel belt 68 having one end 70 thereof anchored to the wheel-like member 62 and being wrapped clockwise, as viewed in the figures, around wheel 66 and back around wheel-like member 62, to be anchored by an adjustable anchor 72 pulling against a spring 74 extending between the anchor and the stainless steel belt 68 to provide the desired tension in the belt. The belt is also positively retained with respect to wheel 66 to prevent any slippage with respect thereto by a clamp bolt 76 positively clamping the belt to the wheel 66 at the location of the clamp.

Figure 6:
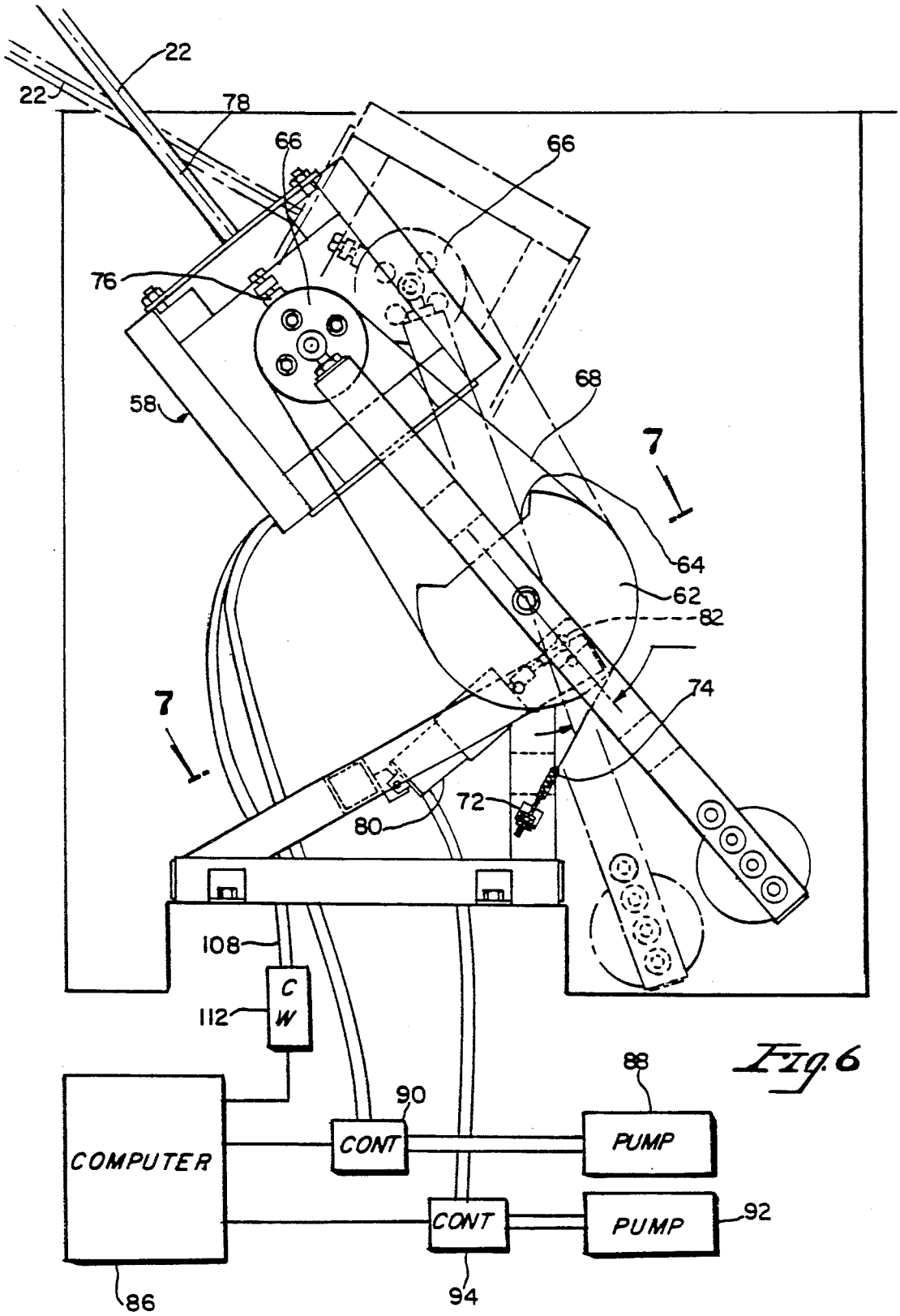
FIG. 6 is a side view of the apparatus of the preferred embodiment illustrating the motion of the laminar flow nozzle and the support structure therefor, as well as the control system for controlling the same.

For the foregoing arrangement, it may be seen that the assembly having the laminar flow nozzle 58 at one end thereof and the counterbalance 62 at the other end thereof is a balanced assembly, with rotation about shaft 54 over a reasonable angular freedom being possible. In so rotating, if wheel 66 and wheel-like member 62 were of the same diameter, laminar flow nozzle 58 would swing in a arc, but not rotate at all in space about its center of gravity, thereby changing the location of the origin of the laminar flow stream but not the angle thereof. By making wheel 66 smaller than the wheel-like member 62, the laminar flow nozzle will be caused to rotate about its center of gravity also as the entire structure rotates about the axis of shaft 54 by the effect of belt 68. This is illustrated in FIG. 6, wherein it is shown that as the assembly on which the laminar flow nozzle is mounted rotates clockwise about the axis of shaft 54, the laminar flow nozzle will be caused to rotate in the counter clockwise direction with respect to the fixed base. Thus, as shown is FIG. 6 the laminar flow streams 22 illustrated as eminating from the laminar flow nozzle in two specific orientations of the assembly will pass through a point in space 78 positioned above the nozzle by an amount dependent upon the relative size of wheel 66 and the wheel-like member 62. For other relative positions of the assembly, the laminar flow stream 22 will have different angles, but will still pass through point 78, so that if point 78 is positioned at ground level, control of the position of the assembly will cause the laminar flow stream to appear to be eminating from a fixed point on the ground, but at different angles as desired.

In order to control the assembly, a pneumatic cylinder 80 is coupled between one of the cross members 40 on the fixed frame assembly and a pin 82 (see particularly FIG. 4) passing through a clevis-like member 84 welded to crossbar 52 on the rotatable assembly. Since the axis of pin 42 is effectively below the axis of shaft 54 on which the assembly rotates, extension of the pneumatic cylinder will cause a rotation of the assembly an a counter clockwise direction, and vice versa. These various components hereinbefore described are also visible in FIG. 7, a view taken along line 7—7 of FIG. 6.

The control for the system is shown schematically in FIG. 6. In particular, a computer, typically a personal computer such as an IBM PC or a PC compatible computer 86 controls the pressure of the water supplied by pump 88 to the laminar flow nozzle 58 by an appropriate controller 90. Similarly, the supply to the pneumatic cylinder 80 from pump 92 is controlled by controller 94. In general these controls may be any form of well known controls for such purpose. By way of specific example, for the control of the water to the laminar flow nozzle one can control the flow of water from the pump to the laminar flow nozzle based upon the desired pressure in the laminar flow nozzle enclosure, or based upon the pressure measured at a representative point in the supply line supplying the laminar flow nozzle. Alternatively, the flow of the water could be controlled to provide the desired pressure or pressure profile by pumping the water through a restriction in the line, and thereafter dumping a portion thereof to drain, the amount being dumped at any time being selected to provide the desired control of the water pressure in the laminar flow nozzle. Control of the pump 88 itself to deliver different pressures, though possible, normally would be more difficult than operating the pump at a fixed power level and otherwise controlling the flow. Similarly, in the case of control of the pneumatic cylinder 80, one could use a position feedback so that the controller 94 would operate on the difference between the commanded position from the computer 86 and the actual current position of the pneumatic cylinder, or alternatively, the pneumatic cylinder could be frequently returned to a known position so as to avoid long term drift in the pneumatic cylinder position because of the inaccuracy of such controls without position feedback. In that regard, for this purpose a turnbuckle type adjustment 96 (see FIG. 7) is provided in the coupling between the pneumatic cylinder 80 and the rotatable assembly to allow for manual adjustment to set the coincidence between a known pneumatic cylinder position and the desired equivalent laminar flow stream orientation.

Figure 10:
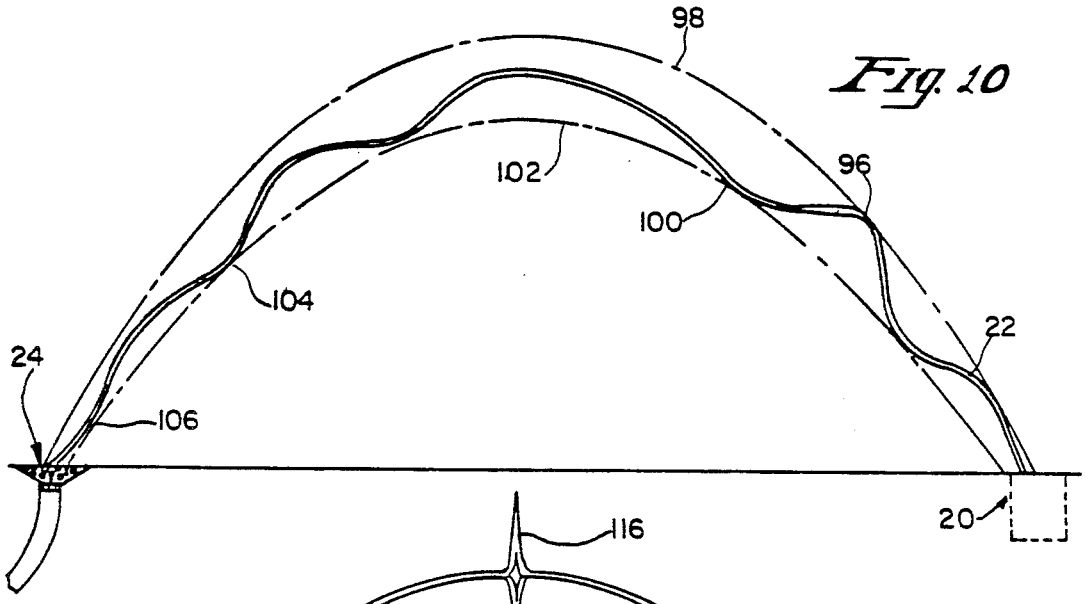
FIG. 10 is an illustration of a dynamic water display utilizing the preferred embodiment of the present invention.

Now referring to FIG. 10, the advantage of the structure hereinbefore described and the results thereof may be seen. As shown, a nozzle assembly, generally indicated by the numeral 20, directs a laminar flow stream 22 upward to curve over and proceed downward to a sink region, generally indicated by the numeral 24. While the laminar flow stream 22 can be given an irregular shape by only varying the pressure of the water supplied to the laminar flow nozzle, the stream will wander around the sink 24, sometimes falling short thereof and sometimes falling beyond the same, depending upon how the pressure in the laminar flow nozzle is varied. However, by controlling both pressure in the laminar flow nozzle and the angle of the stream, the laminar flow stream 22 may be given the shape illustrated in FIG. 10 and yet have the stream continually enter the sink region 24 without detectable wander. This may be visualized as follows:

Referring to FIG. 1, the laminar flow stream 22 is shown is a parabolic arch, originating from the laminar flow nozzle generally indicated by the numeral 20 and terminating in the sink region 24. The arch shown however, is only one of a continuous family of archs which could eminate from the laminar flow nozzle 20 and terminate in the sink region 24, with other arches being higher or lower as desired by changing the angle of the laminar flow nozzle through the apparatus hereinbefore described and adjusting the water pressure so that the stream extends to and only to the sink region as desired. In that regard, one could calculate the relationship between pressure and laminar flow stream angle or alternatively the position of the apparatus as controlled by the pneumatic cylinder 80. Preferably, an empirical determination by setting the angle and adjusting the pressure so that the resulting arch terminates in the sink region 24 is used to generate a look up table for use by computer 86 in controlling the system. Note also that as a result of the slug flow, each elemental length of the water stream is much like a separate projectile dispatched by the laminar flow nozzle to follow its own ballistic trajectory to the sink region 24, relatively uneffected by the portion of the stream preceeding or succeeding that section of the stream, as the uniform velocity across the flow area characteristic of slug flow avoids the exchange of water between adjacent stream portions that may be somewhat different trajectories. It is for this reason that slug flow is preferred with the present invention, as otherwise the developed laminar flow with its faster center portion will have such exchange, resulting in a distortion of the glass rodlike characteristic of the flow stream, particularly in a stream as dynamic as that illustrated in FIG. 10.

Thus, with the foregoing explanation in mind, it is apparent that point 96 in the flow stream 22 was emitted from the laminar flow nozzle at an angle and pressure corresponding to arch 98 shown in phantom therein, a relatively high pressure, high angle arch, whereas region 100 in the flow stream not that far from region 96 is on a much lower arch 102, as are regions 104 and 106 corresponding to a shallower angle, lower laminar flow nozzle pressure stream emission. Of course region 96 will continue along the trajectory 98, and of course regions 100, 104 and 106 will continue along trajectory 102, all until such regions enter the sink region 24 at substantially the same point. Of course, portions of the flow following intermediate trajectories will continue to follow such intermediate trajectories until they too enter the sink region 24 at that same point. Thus, it is apparent from FIG. 10 that for a given range of flow stream angle variation, the amount of "wiggle" in the flow stream will appear to increase until the top of the trajectory is reached and will thereafter decrease to zero as the stream enters the sink region. This is not a limitation in the instantaneous profile however, such as the profile shown in FIG. 10, as different parts of the profile at any moment represent water stream portions which were emitted at different times and may instantaneously represent much larger stream angle variations in the rising or falling portions of the stream than at the top of the trajectory.

Another feature of the present invention is illustrated in FIG. 6, 8 and 9. In particular, in FIGS. 8 and 9 a fiber optic bundle is coupled through the wall of the laminar flow nozzle 58 and extends up through flow straigtening means 30 coaxial with the outlet stream 22 so that the upper end 110 thereof terminates somewhat below the exit orifice 34 of the laminar flow nozzle. Light coupled to the fiber optic bundle will thus be directed along the laminar flow stream 22, which itself will act as a large light pipe. In particular, the light eminating from the end of the fiber optic bundle will have a limited angular scatter, and because the laminar flow stream 22 has a smooth glass rodlike outer surface, the same will cause the light to be reflected by the water-air interface to continue along the laminar flow stream by repeated reflection from the water-air interface. Since the laminar flow stream is not perfect, is curved etc., some portion of the light all long the stream will have too high an angle of incidence to the water-air interface to be so reflected, and will "leak out" through the surface of the stream, giving as a net result a laminar flow stream which will glow along its length with a color dependent upon the color of the light supplied thereto, giving a most unusual and fascinating nighttime display. As may be seen in FIG. 6, a color wheel 112 may be controlled by computer 86 to give a continuously changing colored stream, or alternatively to command color changes as part of the choreography of the laminar flow stream synchronized with the motions thereof, or if desired, the color and motion of the stream being synchronized to still other phenomenon such as music, etc.

Figure 11:
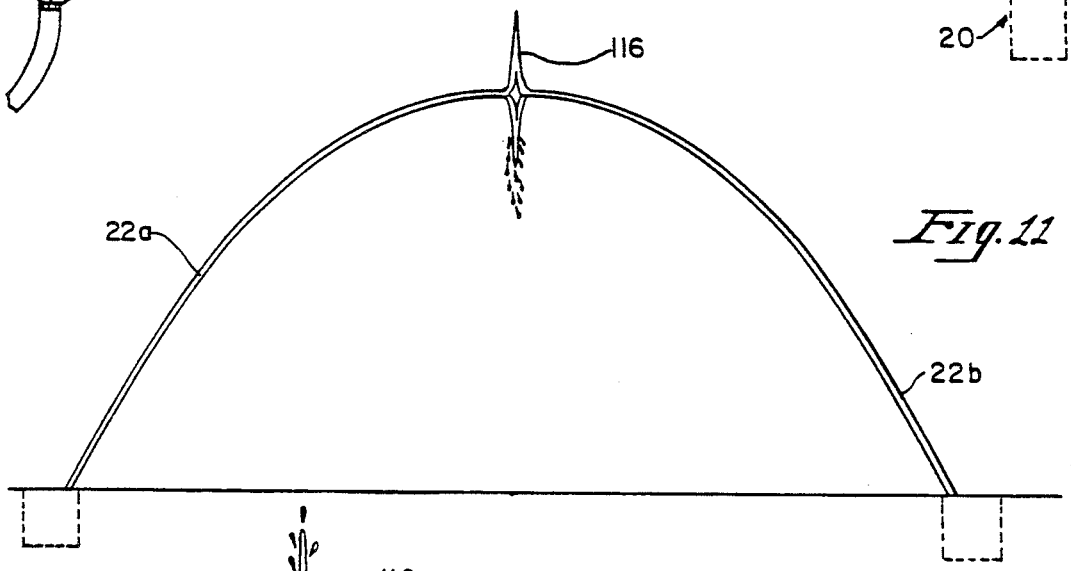
FIG. 11 is an illustration of another form of water display achievable with the present invention.
Figure 12:
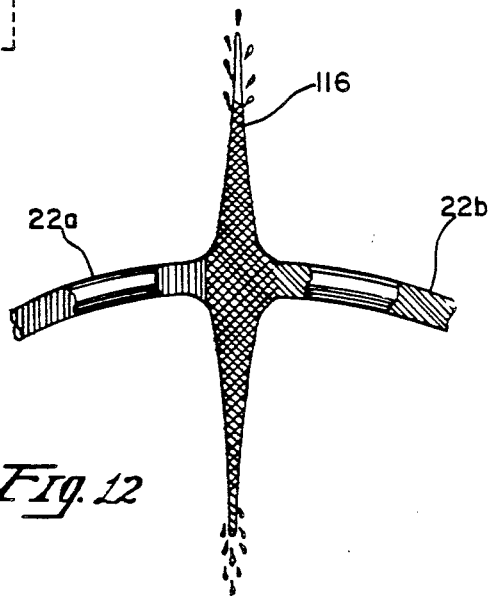
FIG. 12 is an expanded view of the area of intersection of the two laminar flow streams 22*a* and 22*b* of FIG. 11.

Now referring to FIG. 11, another form of display achieveable by the present invention may be seen. Here two laminar flow nozzles 20 direct laminar flow streams 22*a* and 22*b* upward from opposite ends of the same arch to collide at the top and fan outwards in region 116. By supplying the two laminar flow nozzles with water of the same pressure and controlling the orientation of the same in unison, the laminar flow streams 22 may be moved up and down or caused to wiggle as shown in FIG. 10 in a symmetrical way, with the fan shape region 116 moving up and down accordingly. In this embodiment, interesting motions may be achieved by varying the pressure only, the angle of both streams only, or both the pressure and angle. By varying the pressure, angle and position of the nozzles simultaneously, the streams may be caused to eminate from two points, pass through two fixed points in space as if each stream is hung on one of the respective points, and to collide as before, independent of the trajectories. By illuminating the two laminar flow streams with lights of a different color, such as by way of example as shown in FIG. 12, illuminating laminar flow stream 22*a* with red and laminar flow stream 22*b* with green, the two flow streams will each glow with the respective color, but in the fan shaped region 116, the colors will mix to create a yellow fan shaped region. In certain instances, the fan shaped region 116 may not be centered as shown in FIG. 11, but may occur substantially to one side of the center of the display, resulting in the same curving to a sort of mushroom shape under the influence of gravity. In either case, it should be noted that because of the slug flow in the laminar flow streams, the flow in the fan shape region 116 is relatively well behaved except sufficiently far away from the point of collision where the sheet of water fans out to the extent that surface tension breaks the same into small droplets at the outer periphery thereof.

In certain instances, one can obtain the desired effect by varying the pressure of the water to the laminar flow nozzle without varying the angular orientation of the nozzle in a complimentary manner. This will result in the laminar flow stream having interesting and time varying wiggles as intended. It will also result in the stream coming down at various distances from the laminar flow nozzle, dependent upon the pressure of the water supply to the nozzle at the time that part of the stream was emitted through the nozzle orifice, but will be of no significant consequence if, by way of example, the stream is going down into a pool of significant size, or onto a patio deck having suitable drainage, such as an open joint paving patio deck providing substantial drainage between deck slabs. While an interesting effect can be achieved this way from a single laminar flow nozzle, a plurality of nozzles in side-by-side relationship driven by a common variable pressure water source provides an even more interesting display because of the inherent syncronism in the animation of each of the plurality of streams.

There has been described herein new and unique water displays utilizing laminar flow nozzles and preferably laminar flow nozzles which generate a slug flow for various decorative and entertainment purposes. While various embodiments of the invention have been disclosed and described herein, it will be understood by those skilled in the art that various changes in form and detail may be made therein without departing from the spirit and scope of the invention.

We claim:

1. A water display comprising;

a source of water under pressure;

first and second laminar flow nozzles disposed at different locations operatively connected to the source of water, the nozzles each having an outlet adapted to direct a substantially laminar flow stream toward the laminar flow stream of the other nozzle to collide therewith for viewing by observers of the water display, the laminar flow stream of each nozzle having a predetermined trajectory projected at a predetermined angular elevation; and light source means disposed in said laminar flow nozzles for directing light substantially along an axis essentially parallel with each laminar flow stream emitted thereby, said light source means being adapted to direct a different color along each laminar flow stream, wherein said laminar flow stream of said first laminar flow nozzle has a first color and said laminar flow stream of said second laminar flow nozzle has a second color whereby the laminar flow streams will appear illuminated along at least a substantial part of their length and said first and second colors combine to create a third color where said laminar flow streams collide.

2. The water display of claim 1 wherein said light source means include fiber optic bundles, each having one end adjacent and substantially coaxial with the respective said laminar flow nozzle outlet to direct light entering the other end of said fiber optic bundle substantially coaxially along a stream of water emitted by said laminar flow nozzle.

* * * * *